US005813376A

United States Patent [19]

Sakaguchi et al.

[11] Patent Number: 5,813,376

[45] Date of Patent: Sep. 29, 1998

[54] APPARATUS FOR SUPPLYING OIL IN ENGINE

[75] Inventors: Yuichi Sakaguchi, Nagoya; Hiroyuki Kawase, Okazaki; Koichi Shimizu, Toyota; Yuuji Yoshihara, Toyota; Hiromasa Suzuki, Toyota, all of Japan

[73] Assignee: Toyota Jidosha Kabushiki Kaisha, Toyota, Japan

[21] Appl. No.: 936,108

[22] Filed: Sep. 23, 1997

[30] Foreign Application Priority Data

Sep. 24, 1996 [JP] Japan ..... 8-251759

[51] Int. Cl.[6] ..... F02D 13/02; F01L 1/34; F01L 13/00

[52] U.S. Cl. ..... 123/90.16; 123/90.34; 123/90.36

[58] Field of Search ..... 123/90.12, 90.15, 123/90.16, 90.17, 90.18, 90.33, 90.34, 90.36, 90.39, 90.44, 196 R, 196 M

[56] References Cited

U.S. PATENT DOCUMENTS

| | | | |
|---|---|---|---|
| 4,794,892 | 1/1989 | Konno | 123/90.36 |
| 4,800,850 | 1/1989 | Yoshida et al. | 123/90.36 |
| 4,807,574 | 2/1989 | Shibata et al. | 123/90.36 |
| 5,195,474 | 3/1993 | Urata et al. | 123/90.33 |
| 5,220,891 | 6/1993 | Nakamura et al. | 123/90.33 |
| 5,495,832 | 3/1996 | Fujii et al. | 123/90.16 |
| 5,537,963 | 7/1996 | Hasebe et al. | 123/90.16 |

FOREIGN PATENT DOCUMENTS

| | | |
|---|---|---|
| 3-13403 | 2/1991 | Japan . |
| 4-32205 | 5/1992 | Japan . |
| 5-43847 | 7/1993 | Japan . |
| 8-014015 | 1/1996 | Japan . |

*Primary Examiner*—Weilun Lo
*Attorney, Agent, or Firm*—Kenyon & Kenyon

[57] ABSTRACT

An engine has a crankshaft, a combustion chamber and a valve. The valve opens and closes the combustion chamber. The valve has a lift characteristic that is altered by a control device according to a change of hydraulic pressure therein. The engine has a lubricant passage that is connected with an oil pump and supplies oil to a mechanism formed by parts slidably connecting one another within the engine. A hydraulic pressure passage extends into an interior of the control device to exchange the hydraulic pressure with the control device, thereby the control device is actuated to alter the lift characteristic. The oil pump supplies the oil to the pressure passage when connected with the pressure passage. The oil pan supplies the oil to the pressure passage when connected with the pressure passage. A switching valve selects one of the oil pump and the oil pan to connect the selected one with the control device based on the engine speed.

20 Claims, 5 Drawing Sheets

APPARATUS FOR SUPPLYING OIL IN ENGINE

BACKGROUND OF THE INVENTION

1. Field of the Invention

The present invention relates to an apparatus for supplying oil in engines. More particularly, the present invention pertains to an improved apparatus for supplying oil to a hydraulic valve mechanism of engines.

2. Description of the Related Art

Many existing engines are equipped with a mechanism for varying valve lift of a set of intake valves or a set of exhaust valves. This enhances the power and performance of the engine and reduces undesirable emissions. Japanese Examined Patent Publication No. 4-32205 discloses such a variable valve lift mechanism.

As shown in FIG. 4, a mechanism 71 for varying valve lift includes a rocker shaft 73, in which an oil pressure passage 72 is defined. Low speed rocker arms 74 and a high speed rocker arm 75 are pivotally mounted on the rocker shaft 73 in association with two valves. The rocker arms 74, 75 are pivoted about the axis of the rocker shaft 73 by low speed cams and a high speed cam (neither of which is shown), respectively. Pivoting of the low speed rocker arms 74 about the axis of the rocker shaft 73 opens and closes the valves.

A hole 76 extends in the low speed and high speed rocker arms 74, 75 parallel to the rocker shaft 73. A segmented coupling pin 77 is slidably fitted in the hole 76. An oil chamber 78 is defined between the upper end of the pin 77 and the upper end of the hole 76 (as viewed in FIG. 4). The chamber 78 communicates with the oil pressure passage 72. A coil spring 79 extends between the lower end of the coupling pin 77 and the lower end of the hole 76 (as viewed in FIG. 4).

The oil pressure passage 72 is connected to a switching valve 80. The switching valve 80 is further connected to a supply passage 81 and a draining passage 82. The supply passage 81 is connected to an oil pan 84 via an oil pump 83, whereas the draining passage 82 is directly connected to the oil pan 84.

When the switching valve 80 communicates the supply passage 81 with the oil pressure passage 72, oil discharged from the oil pump 83 is supplied to the oil pressure passage 72 via the supply passage 81 and the switching valve 80 to deliver oil to the chamber 78. The delivered oil increases the pressure in the chamber 78. The increased pressure displaces the pin 77 against the force of the spring 79. As a result, the pin 77 couples the low speed rocker arms 74 with the high speed rocker arm 75 and causes the low speed rocker arms 74 to pivot integrally with the high speed rocker arm 75. As a result, the valve is opened and closed by the high speed cam. This increases the valve lift.

When the switching valve 80 communicates the oil pressure passage 72 with the draining passage 82, oil in the oil pressure passage 72 is drained to the oil pan 84 via the switching valve 80 and the draining passage 82. Accordingly, the oil pressure in the chamber 78 is lowered. This causes the force of the coil spring 79 to move the pin 77 in the reverse direction, which is upward in the view of FIG. 4. As a result, the low speed rocker arms 74 are uncoupled from the high speed rocker arm 75. This causes the valve to be opened and closed by the low speed cam. This decreases the valve lift.

The valve lift is generally changed based on the engine speed. For example, when the engine is running at a lower speed, the valves are opened and closed by the low speed cam to decrease the amount of air drawn into the engine. When the engine is running at a higher speed, the valves are opened and closed by the high speed cam to increase the amount of air drawn into the engine.

Japanese Examined Patent Publication No. 3-13403 discloses an apparatus for supplying oil to variable valve lift mechanism.

As shown in FIG. 5, the apparatus includes a variable valve lift mechanism 71 and an oil pressure passage 72 connected to the mechanism for delivering oil thereto. The passage 72 is connected to an oil passage 85 in series. The passage 85 injects oil through holes formed therein to lubricate low speed and high speed cams. The passages 72, 85 are connected to an oil pump 83 via a flow control switching valve 87. The valve 87 includes a variable orifice 86 and is connected to an oil pump 83. The oil pump 83 is driven by a crankshaft of the engine (not shown).

When the engine is running at a high speed, the switching valve 87 sends oil from the oil pump 83 to the oil pressure passage 72. The oil then flows to the passage 85. In this state, the restriction amount of the orifice 86 is controlled to deliver enough oil to the chamber 78 to displace the pin 77 against the force of the spring 79. Thus, the oil pressure actuates the mechanism 71 and switches the cams for increasing the valve lift. Part of the oil passing through the oil passage 85 is injected from holes for lubricating the sliding parts of the cams.

When the engine is running at a low speed, the switching valve 87 sends oil from the oil pump 83 to the oil passage 85. The oil then flows to the passage 72. In this state, the restriction amount of the orifice 86 is controlled so that the oil pressure in the chamber 78 is too low to displace the pin 77 against the force of the spring 79. As a result, the mechanism 71 switches the cams to decrease the valve lift. Part of the oil passing through the oil passage 85 is supplied to the cams for lubricating the sliding parts of the cams.

In the apparatus of the publication No. 4-32205, when the supply passage 81 is disconnected from the oil pressure passage 72 and the draining passage 82 is communicated with the passage 72, oil in the passage 72 is drained to the oil pan 84. Therefore, air may be trapped in the passage 72. The trapped air mixes with oil in the passage 72 when the mechanism 71 is operating and degrades the response of the mechanism 71.

In the apparatus of the publication No. 3-13403, on the other hand, the oil pressure passage 72 is constantly filled with oil. Therefore, air is prevented from being trapped in the passage 72. However, the variable valve lift mechanism 71 must be controlled by changing oil pressure in the passage 72. Thus, the flow control switching valve 87 must have the variable orifice 86. This complicates the construction of the valve 87.

SUMMARY OF THE INVENTION

Accordingly, it is an objective of the present invention to provide an oil supplying apparatus that has a simple construction and prevents air from entering an oil pressure passage thereby improving the response of a variable valve lift mechanism.

To achieve the foregoing and other objectives and in accordance with the purpose of the present invention, an apparatus for supplying lubricant oil to an engine is provided. The engine has a crankshaft, a combustion chamber, a valve that selectively opens and closes the combustion chamber. The valve has a lift characteristic, a control device for altering the lift characteristic according to a change of hydraulic pressure therein, and a lubricant passage connected with the a first supplying means to supply oil to a mechanism within the engine. The apparatus includes a hydraulic pressure passage, a second supplying means and selecting means. The hydraulic pressure passage extends into an interior of the control device to exchange the hydraulic pressure with the control device thereby actuating the control device to alter the lift characteristic. The first supplying means is arranged to supply the oil to the pressure passage when connected with the pressure passage. The second supplying means auxiliarily supplies the oil to the pressure passage when connected with the pressure passage. The selecting means selects one of two supplying means to connect the selected supplying means with the control device based on the engine speed.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

FIG. 2(*a*) is a flowchart illustrating the operation of the ECU 38;

DETAILED DESCRIPTION OF THE PREFERRED EMBODIMENTS

A preferred embodiment of the present invention will now be described with reference to FIGS. 1 to 3.

Figure 1:
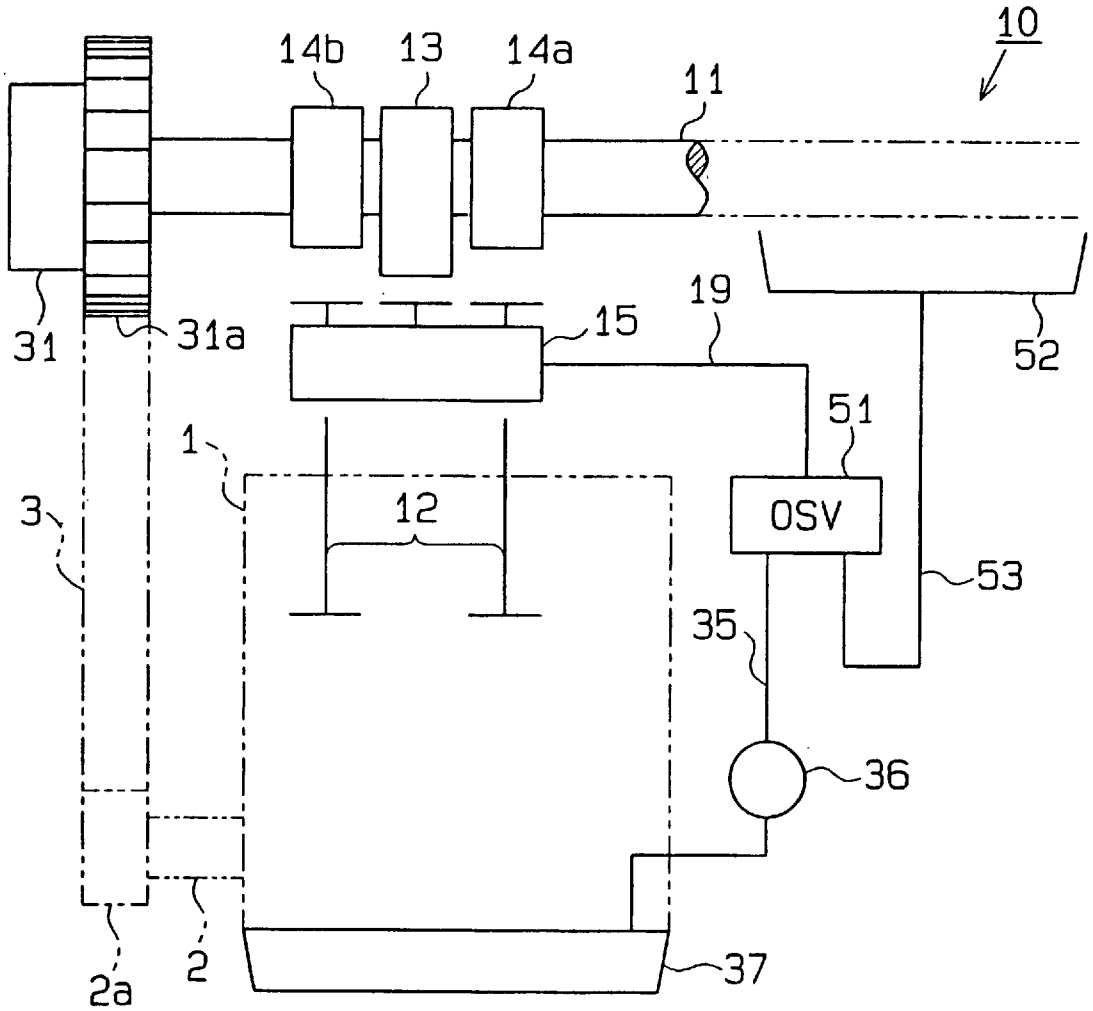
FIG. 1 is a diagram partially illustrating a variable valve lift mechanism and a lubricating mechanism according to a preferred embodiment of the present invention.

As shown in FIG. 1, a crankshaft 2 is rotatably supported in the lower portion of an engine 1. The crankshaft 2 is provided with a pulley 2*a* fixed to its distal end. The engine 1 also includes a camshaft 11 rotatably supported in the upper portion. The camshaft 11 is provided with a high speed cam 13 and a pair of low speed cams 14*a*, 14*b* in association with a pair of valves 12.

The low speed cams 14*a*, 14*b* sandwich the high speed cam 13. The profiles of the low speed cams 14*a*, 14*b* differ from that of the high speed cam 13. The valve lift of the valves 12 when actuated by the high speed cam 13 is greater than the valve lift of the valves 12 when actuated by the low speed cams 14*a*, 14*b*. A variable valve lift mechanism 15 is located between the cams 13, 14*a*, 14*b* and the valves 12 for switching operation of the valves between the high speed cam 13 and the low speed cams 14*a*, 14*b*. The variable valve lift mechanism per se is well known in the art.

The variable valve lift mechanism 15 is connected to an oil switching valve (OSV) 51 by an oil passage 19. The OSV 51 is connected to an oil pan 37 provided in the lower portion of the engine 1 via an oil pump 36. The pump 36 is coupled to and rotated by the crankshaft 2. The OSV 51 is also connected to an oil receiver 52, which is located at a position higher than the variable valve lift mechanism 15.

The construction of the variable valve lift mechanism 15 will hereafter be described with reference to FIG. 2.

Figure 2:
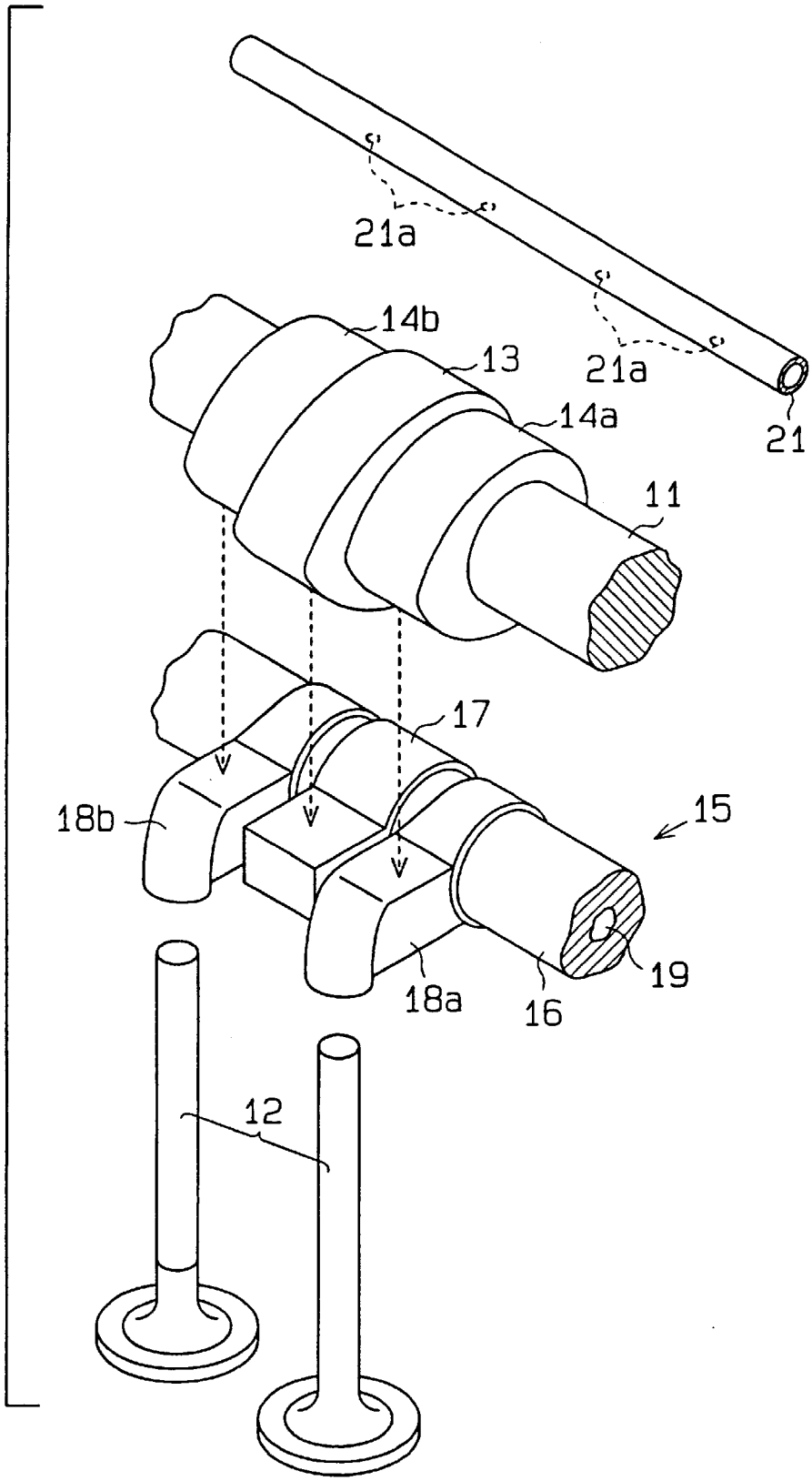
FIG. 2 is an exploded partial perspective view illustrating a variable valve lift mechanism of FIG. 1.
Figure 2A:
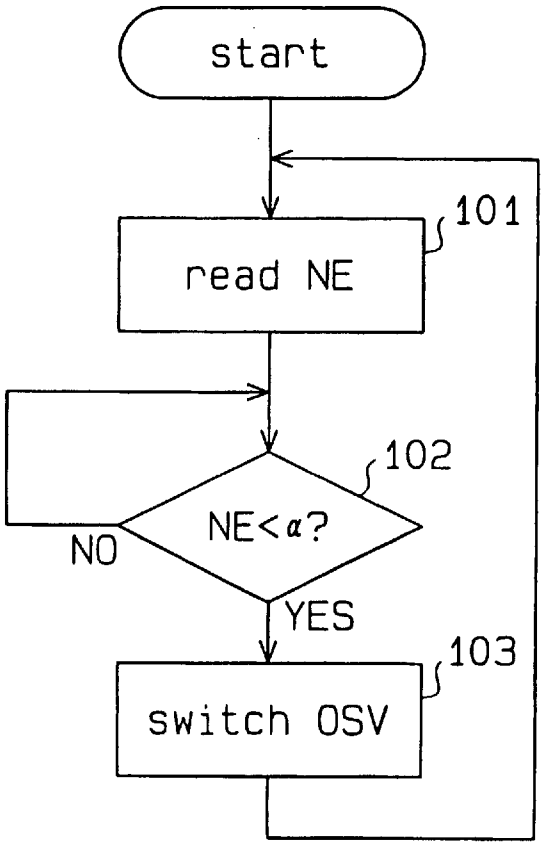

As shown in FIG. 2, the mechanism 15 includes a rocker shaft 16 extending parallel to the camshaft 11. The rocker shaft 16 has a high speed rocker arm 17, which corresponds to the high speed cam 13, and low speed rocker arms 18*a*, 18*b*, which correspond to the low speed cams 14*a*, 14*b*.

The high speed and low speed rocker arms 17, 18*a*, 18*b* pivot about the axis of the rocker shaft 16. The lower distal end of each low speed rocker arm 18*a*, 18*b* is aligned with one of the valves 12. The oil passage 19 is defined in the rocker shaft 16 and is communicated with the low speed rocker arm 18*a*.

Figure 5:
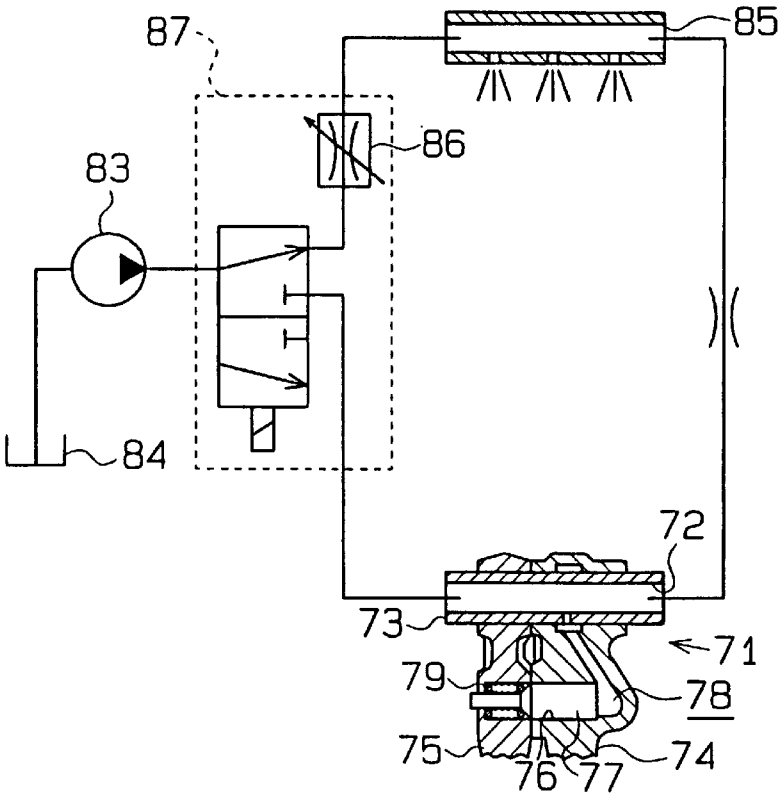
Fig. 5 (PRIOR ART)
FIG. 5 is a diagram illustrating a prior art oil supply circuit.
Figure 4:
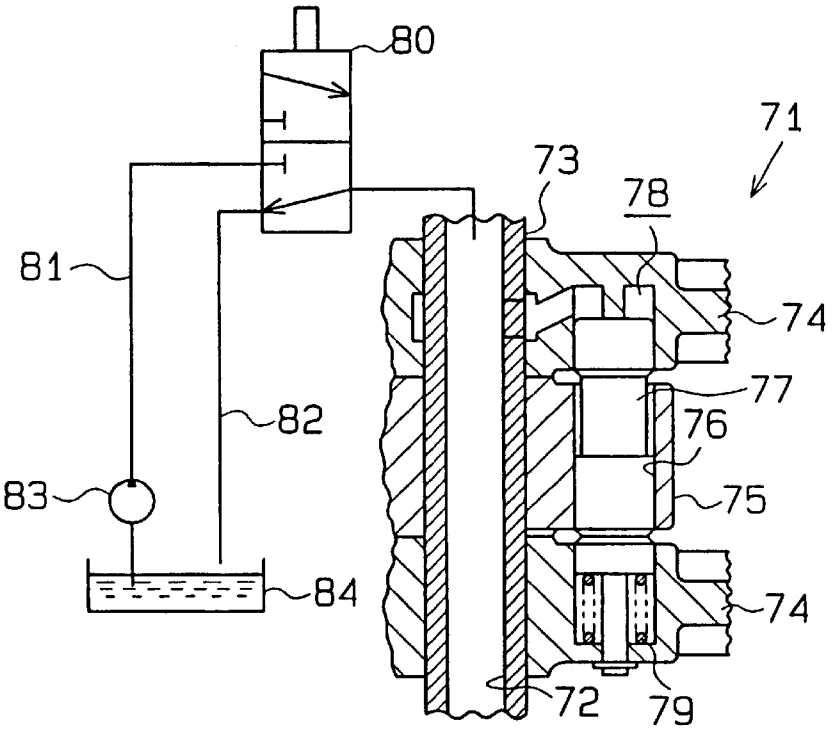
Fig. 4 (PRIOR ART)
FIG. 4 is a diagram illustrating a prior art oil supply circuit.

When oil is supplied to the oil passage 19 to increase the pressure in the passage 19, a coupling pin in each associated set of rocker arms 17, 18*a*, 18*b* (see FIGS. 4 and 5) is moved to a position to connect the low speed rocker arms 18*a*, 18*b* to the corresponding high speed rocker arm 17. In this state, the associated valves 12 are opened and closed by the high speed cam 13 by way of the high speed rocker arm 17 and the low speed rocker arms 18*a*, 18*b*.

When the pressure in the passage 19 is decreased, the coupling pin is moved to a position to disconnect the low speed rocker arms 18*a*, 18*b* from the corresponding high speed rocker arm 17. In this state, the valves 12 are opened and closed by the low speed cams 14*a*, 14*b* by way of the low speed rocker arms 18*a*, 18*b*.

An oil passage 21 is located above the cams 13, 14*a*, 14*b* parallel to the camshaft 11. The passage 21 has holes 21*a*, which open to the cams 13, 14*a*, 14*b*. Oil supplied to the cams 13, 14*a*, 14*b* from the holes 21*a* lubricates sliding surfaces of the cams 13, 14*a*, 14*b* and the rocker arms 17, 18*a*, 18*b*. The oil then flows to the oil receiver 52.

As shown in FIG. 1, a variable valve timing mechanism 31 is provided at one end of the camshaft 11. The mechanism 31 advances or retards the rotational phase of the camshaft 11 relative to the crankshaft 2. The mechanism 31 includes a pulley 31*a*, which is coupled to the crankshaft 2 by a pulley 2*a* and a timing belt 3. The pulley 31*a* is coupled to the camshaft 11 by a movable member (not shown) such as an existing ring gear, which functions as a hydraulic piston. When oil is supplied to the mechanism 31, the pressure of the oil actuates the movable member to change the rotational phase of the pulley 31*a* relative to that of the camshaft 11.

Figure 3:
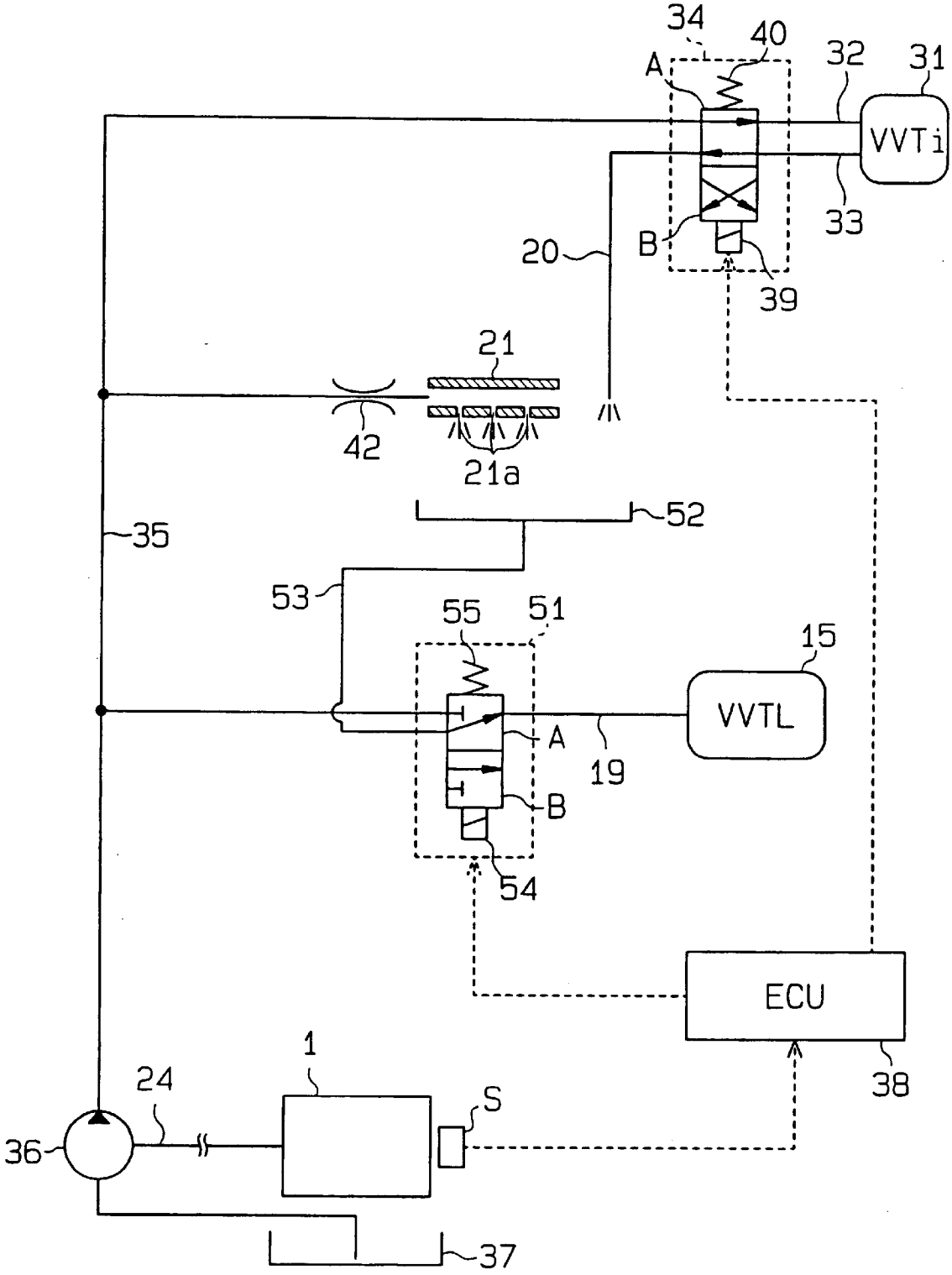
FIG. 3 is a diagram illustrating an oil circuit for supplying oil to the mechanism of FIG. 2.

FIG. 1 does not fully illustrate the hydraulic circuit, however, FIG. 3 shows the complete circuit.

The operation of the ECU 38 will now be described with reference to a flowchart of FIG. 2(*a*).

Suppose the engine 1 is currently running at a high speed and the B combination of the OCV 51 is aligned with the oil passage 19. The ECU 38 computes the speed NE of the engine 1 based on signals from an engine speed sensor S at step 101. At step 102, the ECU 38 judges whether the engine speed NE is less than a predetermined value $\alpha$. If the determination is positive, the ECU 38 moves to step 103. At step 103, the ECU 38 sends a signal to the OSV 51 to de-energize the solenoid 54 thereby causing the A combination of the OSV 51 to operate. As a result, the oil receiver 52 is connected to the mechanism 51.

A hydraulic circuit that actuates the variable valve lift mechanism 15 and the variable valve timing mechanism 31 by supplying oil to and draining oil from the mechanisms 15, 31 will hereafter be described with reference to FIG. 3.

As shown in FIG. 3, the variable valve timing mechanism (VVTi) 31 is connected to an oil control valve (OCV) 34 via a phase advancing oil conduit 32 and a phase retarding oil conduit 33. The OCV 34 is connected to the oil pan 37 via an oil supply passage 35. A draining passage 20 is also connected to the OCV 34.

The OCV 34 is controlled by an electronic control unit (ECU) 38. The OCV 34 is a two position type electromagnetic valve having four ports, an electromagnetic solenoid 39 and a coil spring 40. The OCV 34 further has two port combinations, A and B. When the solenoid 39 is not energized, the OCV 34 employs the A combination, which is held in alignment with the conduits 32, 33, by the force of the coil spring 40. When the solenoid 39 is energized, the OCV 34 is moved so that the B combination is aligned with the conduits 32, 33.

When the A combination is selected, the oil supply passage 35 is communicated with the phase advancing oil conduit 32, and the draining passage 20 is communicated with the phase retarding oil conduit 33. In this state, the pump 36 supplies oil from the oil pan 37 to the VVTi 31 via the supply passage 35, the OCV 34 and the phase advancing oil conduit 32. The oil in the VVTi 31 is drained to the outside via the phase retarding conduit 33, the OCV 34 and the draining passage 20. The VVTi 31, to which oil is supplied from the phase advancing oil conduit 32, advances the rotational phase of the camshaft 11 relative to the rotational phase of the crankshaft 2. This advances the actuation of the valves 12.

When the B combination is selected by the ECU 36, the oil supply passage 35 is communicated with the phase retarding oil conduit 33, and the draining passage 20 is communicated with the phase advancing oil conduit 32. In this state, the pump 36 supplies oil from the oil pan 37 to the VVTi 31 via the oil supply passage 35, the OCV 34 and the phase retarding oil conduit 33. The oil in the VVTi 31 is drained to the outside via the phase advancing conduit 32, the OCV 34 and the draining passage 20. The VVTi 31, to which oil is supplied from the phase retarding oil conduit 33, rotates the rotational phase of the camshaft 11 relative to the rotational phase of the crankshaft 2. This retards the actuation of the valves 12.

The oil passage 21 is connected to the passage 35 upstream of the OCV 34. An orifice 42 is located between the passage 21 and the passage 35 for controlling the oil pressure in the passage 21. Thus, oil is delivered from the passage 35 to the passage 21. The oil is then ejected to the cams 13, 14*a*, 14*b* (see FIG. 2) through holes 21*a* formed in the passage 21 thereby lubricating the sliding surfaces of the cams 13, 14*a*, 14*b* and the valves 12.

The oil passage 19 of the variable valve lift mechanism (VVTL) 15 is connected to the oil supply passage 35 via the oil switching valve (OSV) 51, which is controlled by the ECU 38. The OSV 51 is connected to an oil receiver 52 by an oil line 53. The oil receiver 52 receives oil drained from the draining passage 20 and oil supplied to the sliding parts of the cams 13, 14*a*, 14*b* from the oil passages 21.

The OSV 51 is a two position type electromagnetic valve having three ports, an electromagnetic solenoid 54 and a coil spring 55. The OSV 51 further includes two combinations, A and B, of the ports. When the solenoid 54 is not energized, the A combination is selected and held in position by the force of the coil spring 55. The A combination connects the oil line 53 with the oil passage 19. When the solenoid 54 is energized, the B combination is selected. The B combination shuts off the oil line 53 and communicates the supply passage 35 with the oil passage 19.

The operation of the above oil supply apparatus will now be described.

When changing from the high speed cam 13 to the low speed cams 14*a*, 14*b*, the OSV 51 is controlled to select the A combination for shutting off the oil passage 19 from the supply passage 35 and communicating the oil line 53 with the oil passage 19. This decreases the oil pressure in the passage 19 thereby actuating the variable valve lift mechanism 15 such that the low speed cams 14*a*, 14*b* actuate the valves 12.

Further, when the oil line 53 is communicated with the passage 19, the passage 19 is filled with oil flowing from the oil receiver 52 via the line 53. This prevents air from entering the passage 19. Therefore, failure or delayed response of the mechanism 15 caused by air in the passage 19 is avoided. The operation of the mechanism 15 is thus reliable and responsive. Further, atmospheric pressure acting on the oil receiver 52 causes oil in the passage 19 to flow to the variable valve lift mechanism 15. The oil then lubricates sliding surfaces of the coupling pin in the mechanism 15.

On the other hand, the OSV 51 is controlled to select the B combination for communicating the oil supply passage 35 with the oil passage 19 thereby changing the cams actuating the valves 12 from the low speed cams 14*a*, 14*b* to the high speed cam 13. In this state, oil is supplied to the oil passage 19 from the oil supply passage 35 via the OSV 51. Since the passage 19 is already filled with oil, the oil pressure in the passage 19 is quickly increased. The increased oil pressure in the passage 19 actuates the variable valve lift mechanism 15 to change from the low speed cams 14*a*, 14*b* to the high speed cam 13.

The embodiment of the FIGS. 1 to 3 has the following advantages.

The above described oil supply apparatus requires no variable orifices. This simplifies the construction of the apparatus.

When the A combination of the OSV 51 is selected, atmospheric pressure acting on oil in the oil receiver 52 causes the oil in the passage 19 to flow into the variable valve lift mechanism 15. The oil then lubricates the sliding surfaces of the coupling pin accommodated in the mechanism 15. Therefore, lubrication of the mechanism 15 is guaranteed.

The oil receiver 52 is located at a position higher than the variable valve lift mechanism 15. Therefore, even if the OSV 51 is located lower than the mechanism 15, the passage 19 is filled with oil from the oil receiver 52 when the B combination of the OSV 51 is selected, and thus air is prevented from entering the passage 19. This increases the number of places where the OSV 51 can be located, thus adding to the flexibility of the design.

Oil drained from the variable valve timing mechanism 31 flows into the oil receiver 52 via the draining passage 20. Also, oil injected from the holes 21*a* of the passage 21 for lubricating the cams 13, 14*a*, 14*b* also flows into the oil receiver 52. This construction eliminates the necessity for additional oil to be stored in the receiver 52 and allows the receiver 52 to constantly hold oil.

It should be apparent to those skilled in the art that the present invention may be embodied in many other specific forms without departing from the spirit or scope of the invention. Particularly, it should be understood that the invention may take in the following forms.

(1) In the embodiment of FIGS. 1 to 3, oil from both the draining passage 20 and the oil passage 21 flows into the oil receiver 52. However, oil from only the draining passage 20 or the passage 21 may flow into the oil receiver 52.

(2) In the embodiment of FIGS. 1 to 3, sliding surfaces of the valves 12 and cams 13 14*a*, 14*b* are lubricated by oil from the oil passages 21. However, chains and gears of the engine may be also lubricated by the oil from the passages 21.

(3) In the embodiment of the FIGS. 1 to 3, oil flows into the oil receiver 52 after actuating the variable valve timing mechanism 31 and lubricating the cams 13, 14*a*, 14*b*. However, oil may directly flow into the oil receiver 52 from the oil pump 36.

(4) In the embodiments of FIGS. 1 to 3, the oil pump 36 is actuated by the crankshaft 2. However, the pump 36 may be electrically actuated.

Therefore, the present examples and embodiments are to be considered as illustrative and not restrictive and the invention is not to be limited to the details given herein, but may be modified within the scope and equivalence of the appended claims.

What is claimed is:

1. An apparatus for supplying lubricant oil to an engine, said engine having a crankshaft, a combustion chamber, a valve that selectively opens and closes the combustion chamber, wherein said valve has a lift characteristic, a control device for altering the lift characteristic according to a change of hydraulic pressure therein, and a lubricant passage connected with the a first supplying means to supply oil to a mechanism within the engine, said apparatus comprising:

a hydraulic pressure passage extending into an interior of the control device to exchange the hydraulic pressure with the control device, whereby said control device is actuated to alter the lift characteristic;

said first supplying means being arranged to supply the oil to the pressure passage when connected with the pressure passage;

a second supplying means for auxiliarily supplying the oil to the pressure passage when connected with the pressure passage; and selecting means for selecting one of the two supplying means to connect the selected supplying means with the control device based on the engine speed.

2. The apparatus as set forth in claim 1, wherein said first supplying means includes:

a first oil pan disposed beneath the engine; and an oil pump connected to the first oil pan, wherein said oil pump pumps up the oil from the first oil pan and discharges the oil to the pressure passage.

3. The apparatus as set forth in claim 2, wherein said second supplying means includes a second oil pan receiving the oil that was supplied to the mechanism from the lubricant passage.

4. The apparatus as set forth in claim 3, wherein said selecting means includes:

an electromagnetic valve that switches its positions between said two oil supplying means to connect one of the two supplying means with the pressure passage; and an electric controller for controlling the electromagnetic valve based on the engine speed.

5. The apparatus as set forth in claim 4, further including detecting means for detecting the engine speed, said detecting means outputting a signal based on the detected engine speed to the electric controller.

6. The apparatus as set forth in claim 5, wherein said electric controller controls the electromagnetic valve to connect the second oil pan with the pressure passage when the detected engine speed is lower than a predetermined magnitude.

7. The apparatus as set forth in claim 6, wherein said second oil pan is located in an upper position with respect to the control device.

8. The apparatus as set forth in claim 7, further comprising a variable valve timing device for hydraulically altering a timing relationship of the valve to the crankshaft, wherein said lubricant passage is connected with the control device.

9. The apparatus as set forth in claim 8, wherein said lubricant passage is located in an upper position with respect to the mechanism.

10. The apparatus as set forth in claim 9, wherein said lubricant passage has holes for ejecting the oil to the mechanism.

11. An apparatus for supplying lubricant oil to an engine, said engine having a crankshaft and cam shaft operably coupled to the crankshaft, combustion chamber, a rocker shaft extending in parallel to the cam shaft, a valve that selectively opens and closes the combustion chamber, wherein said valve has a lift characteristic altered by means of a cooperation of cams mounted on the cam shaft and arms rotatably mounted on the rocker shaft, and a lubricant passage connected with the a first supplying means to supply oil to a mechanism formed by parts slidably contacting one another within the engine, said apparatus comprising:

a hydraulic pressure passage extending into the rocker shaft along an axis thereof to change the hydraulic pressure therein so as to alter the lift characteristic;

said first supplying means being arranged to supply the oil to the pressure passage when connected with the pressure passage;

a second supplying means for auxiliarily supplying the oil to the pressure passage when connected with the pressure passage; and selecting means for selecting one of the two supplying means to connect the selected supplying means with the control device based on the engine speed.

12. The apparatus as set forth in claim 11, wherein said first supplying means includes:

a first oil pan disposed beneath the engine; and an oil pump connected to the first oil pan, wherein said oil pump pumps up the oil from the first oil pan and discharges the oil to the pressure passage.

13. The apparatus as set forth in claim 12, wherein said second supplying means includes a second oil pan receiving the oil that was supplied to the mechanism from the lubricant passage.

14. The apparatus as set forth in claim 13, wherein said selecting means includes:

an electromagnetic valve that switches its positions between the pressure passage and said two oil supplying means to connect one of the two supplying means with the pressure passage; and an electric controller for controlling the electromagnetic valve based on the engine speed.

15. The apparatus as set forth in claim 14, further including detecting means for detecting the engine speed, said detecting means outputting a signal based on the detected engine speed to the electric controller.

16. The apparatus as et forth in claim 15, wherein said electric controller controls the electromagnetic valve to connect the second oil pan with the pressure passage when the detected engine speed is lower than a predetermined magnitude.

17. The apparatus as set forth in claim 16, wherein said second oil pan is located in an upper position with respect to the control device.

18. The apparatus as set forth in claim 17, further comprising:

a variable valve timing device for hydraulically altering a timing relationship of the valve to the crankshaft; and said lubricant passage being connected with the control device.

19. The apparatus as set forth in claim 18, wherein said lubricant passage is located in an upper position with respect to the mechanism.

20. The apparatus as set forth in claim 19, wherein said lubricant passage has holes for ejecting the oil to the mechanism.

* * * * *